US005328297A

United States Patent [19]

Handford

[11] Patent Number: 5,328,297

[45] Date of Patent: Jul. 12, 1994

[54] TRENCHLESS REPLACEMENT OF SMALLER DIAMETER LATERAL PIPE SECTIONS

[75] Inventor: Reginald G. Handford, Calgary, Canada

[73] Assignee: Trenchless Replacement Systems Ltd., Calgary, Canada

[21] Appl. No.: 44,617

[22] Filed: Apr. 9, 1993

[51] Int. Cl.[5] ..... F16L 1/028

[52] U.S. Cl. ..... 405/184; 405/154

[58] Field of Search ..... 405/154, 158, 174, 184; 138/97, 105

[56] References Cited

U.S. PATENT DOCUMENTS

| | | | |
|---|---|---|---|
| 4,247,222 | 1/1981 | Schosek | 405/184 |
| 4,507,019 | 3/1985 | Thompson | 405/154 |
| 4,668,125 | 5/1987 | Long | 405/154 |
| 4,685,831 | 8/1987 | Mahoney | 405/184 X |
| 4,964,474 | 10/1990 | Poesch | 405/154 X |
| 5,192,165 | 3/1993 | Torielli | 405/184 X |

FOREIGN PATENT DOCUMENTS 393803 10/1990 European Pat. Off. .

*Primary Examiner*—David H. Corbin

*Attorney, Agent, or Firm*—Elbie R. de Kock

[57] ABSTRACT

An apparatus (10) for the trenchless replacement of a pipe comprises a frame section (12) for location above a service pit (22) exposing one end of an underground pipe section (20) to be replaced and an extendable leg member (14) on the frame section (12) for extending into the service pit (22). A support member (18) is provided on the leg member (14) for supporting the leg member (14) against the inside of the service pit (22). A cable guide member (16) is located on the leg member (14) for guiding a pulling cable (36) extending through the pipe section (20) to be replaced up along the leg member (14). A winch (30) is provided on the frame section (12) for exerting a pulling force on the pulling cable (36).

16 Claims, 8 Drawing Sheets

TRENCHLESS REPLACEMENT OF SMALLER DIAMETER LATERAL PIPE SECTIONS

FIELD OF THE INVENTION

This invention relates to a system for the trenchless replacement of underground pipes, in particular lateral pipe sections which are generally of a smaller diameter than main line pipe sections.

BACKGROUND OF THE INVENTION

In my co-pending application Ser. No. 07/791,513, the entire contents of which is incorporated herein by reference, a system for the trenchless replacement of underground pipes, such as for water and sewerage, is described. This system uses an hydraulic ram as a power source which is placed inside a working pit which is located at one end of a pipe section being replaced. A pipe replacement tool is pulled through from a service pit at the opposite end of the pipeline being replaced by means of a cable or pipe stem connected to the ram.

The lateral pipe replacement system of the present invention is intended to compliment the functions of the larger system described in the above co-pending application. The primary purpose of the system according to the present invention is the trenchless replacement of smaller diameter lateral pipe sections. This system may also be used for the replacement of smaller diameter, shorter sewer mains by the pipe bursting method, i.e., the method by means of which the old pipe being replaced is fractured by means of a pipe bursting tool, such as described in the above-mentioned co-pending application.

SUMMARY OF THE INVENTION

According to the invention, there is provided apparatus for the trenchless replacement of a pipe, comprising an above-ground frame section for location above a service pit exposing one end of an underground pipe section to be replaced; an extendable leg member on said above-ground frame section for extending into said service pit; a support member on said extendable leg member for supporting said leg member against the inside of said service pit; a cable guide member on said leg member for guiding a pipe pulling cable along said leg member; and a winch on said above-ground frame section for exerting a pulling force on said pulling cable.

The leg member may be pivotally connected to said frame section about a horizontal pivotal axis and capable of movement between a vertical position and a horizontal position about said pivotal axis.

The above-ground frame portion may further comprise an attachment member for attachment of the frame portion to the skid of a mechanical front loader or hydraulic excavator.

Further objects and advantages of the invention will become apparent from the description of a preferred embodiment of the invention below.

BRIEF DESCRIPTION OF THE DRAWINGS

The invention will now be described, by way of an example, with reference to the accompanying drawings, in which.

DETAILED DESCRIPTION OF PREFERRED EMBODIMENT

Figure 1:
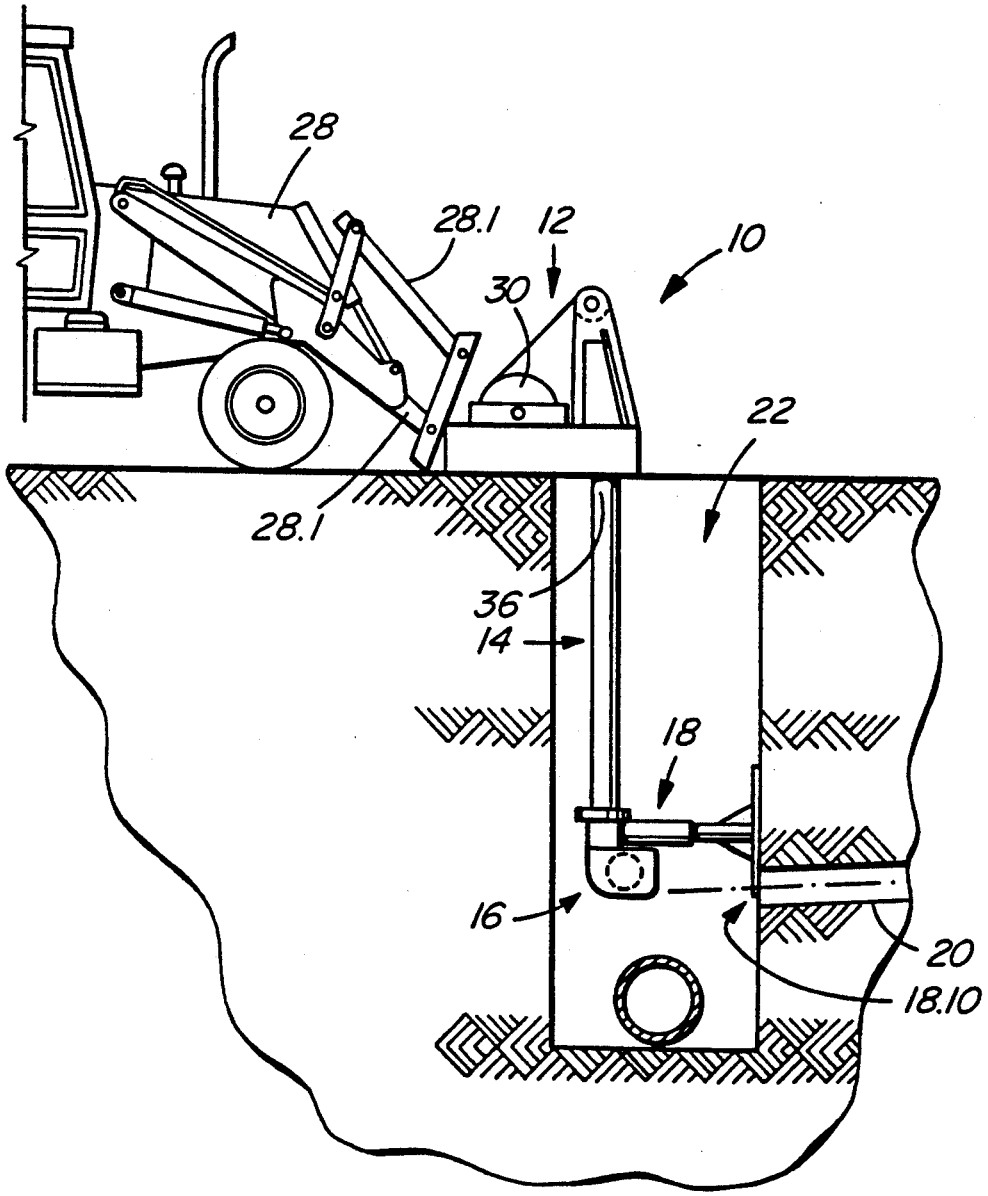
FIG. 1 is a side view of a trenchless pipe replacement system according to the invention, shown attached to a front loader.

Referring to FIG. 1, a laterals replacement system is generally indicated by reference numeral 10. The system 10 comprises a winch assembly 12, a telescopic leg assembly 14, a radially adjustable pulley assembly 16 and an extendable leg support member 18.

In FIG. 1, a lateral pipe to be replaced is indicated by reference numeral 20. As shown, a service pit 22 is dug at one end of the lateral 20 to receive the lateral replacement system 10.

Figure 2A:
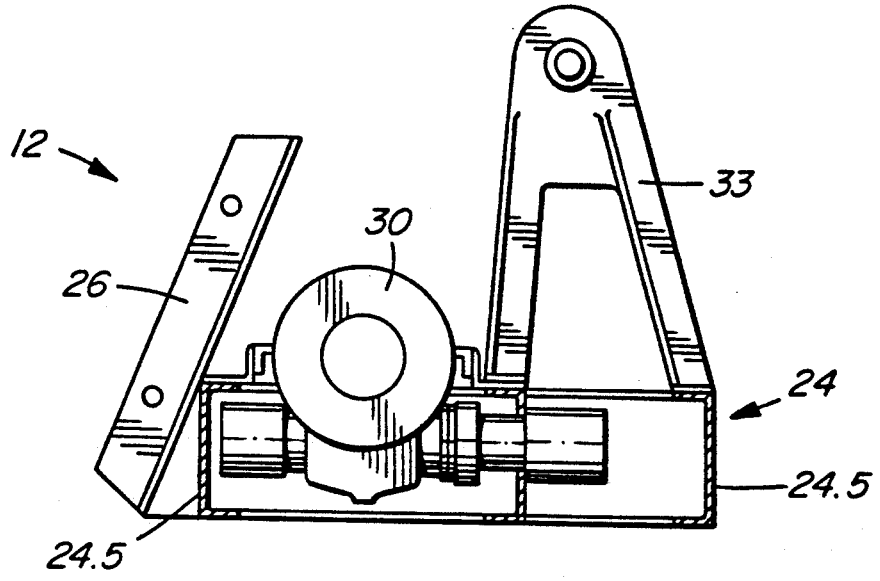
FIGS. 2A–C are side, front and plan views, respectively, of a winch assembly of the system of FIG. 1.
Figure 2B:
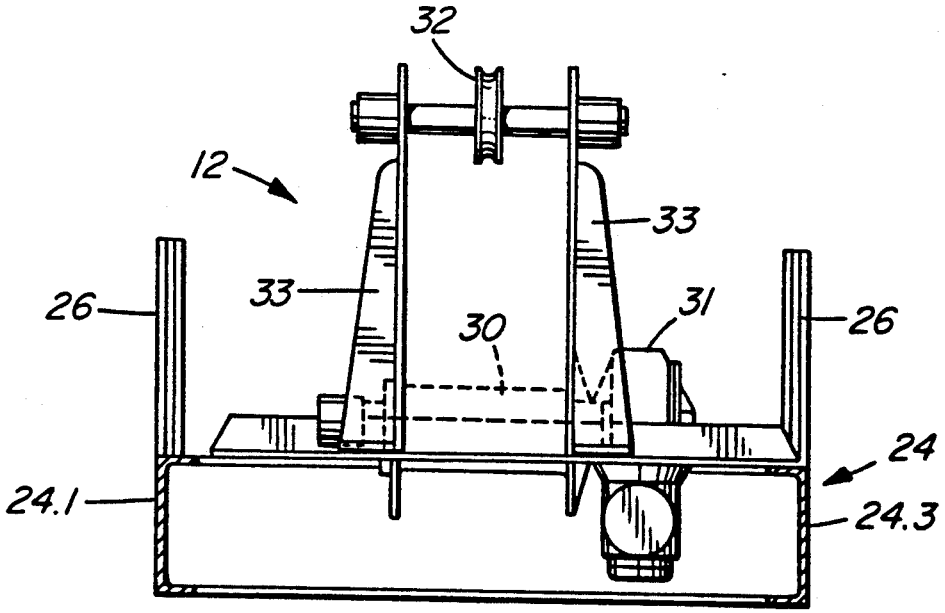
Figure 9A:
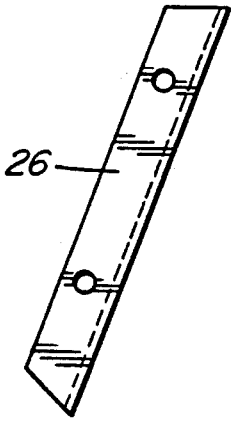
FIGS. 9A and B are a side and a plan view, respectively, of an attachment bracket for attaching the system of FIG. 1 to a front loader.
Figure 9B:
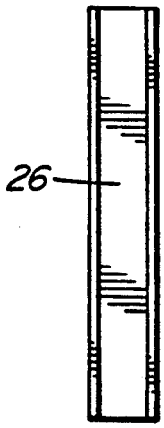

With reference to FIGS. 2A, B and C, the winch assembly 12 of the lateral replacement system 10 comprises a rectangular framework 24 which is made up of side members 24.1, 24.2, 24.3, 24.4, 24.5, 24.6 and 24.7 of suitable channel sections. As shown in FIGS. 2A and B, a pair of brackets 26 for attachment of the frame 24 to the lifting arms 28.1 of a mechanical loader or front loader 28 (FIG. 1) is provided on the frame 24. Side and end views of one of the brackets 26 are more clearly shown in FIGS. 9A and B, respectively. The brackets 26 can be replaced by other suitable coupling means, such as a "quick attach skid" (not shown). The quick attach skid enables the frame 24 to be easily connected to a front loader, such as a skid steer loader and so that it can be operated by the hydraulic system of the skid steer loader through hose attachments and directional control valves (not shown).

A winch 30 is mounted on the frame 24. The winch 30 includes a hydraulic motor 31 and a cable guide pulley 32 which is provided on a pair of raised side members 33.

Figure 2C:
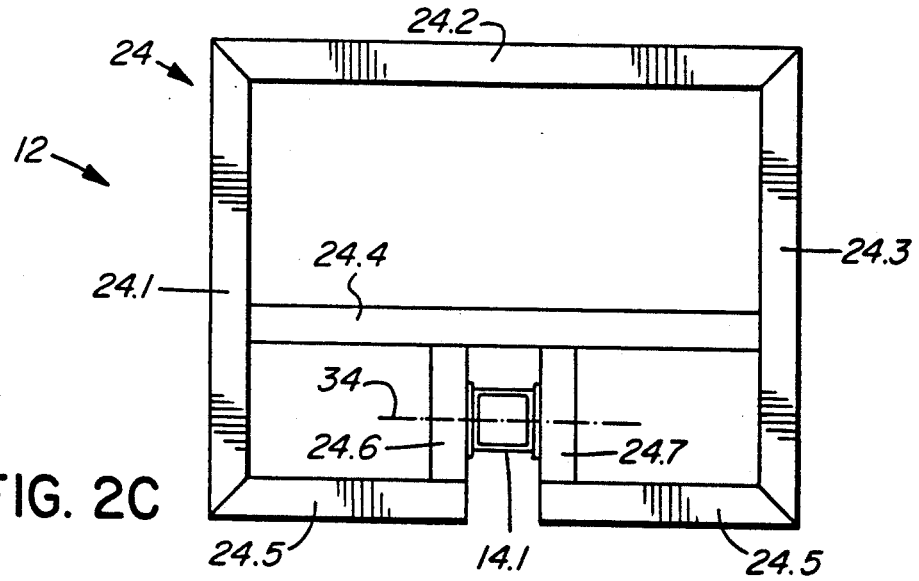
Figure 3A:
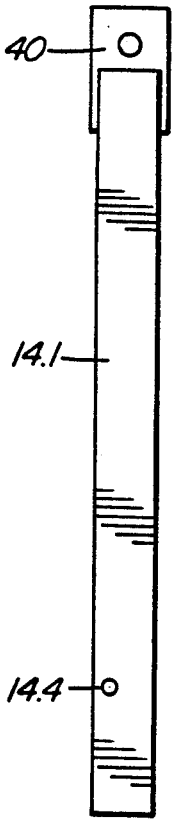
FIGS. 3A and B are two different side views of an upper part of a leg assembly of the system of FIG. 1.
Figure 3B:
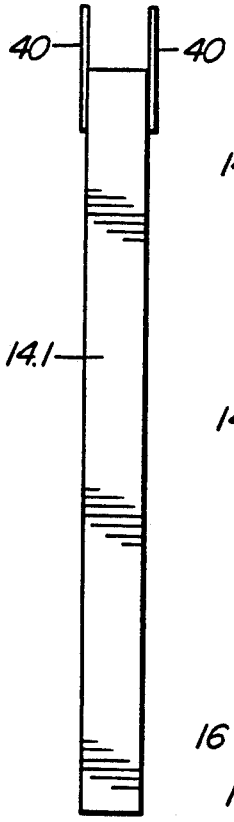
Figure 4A:
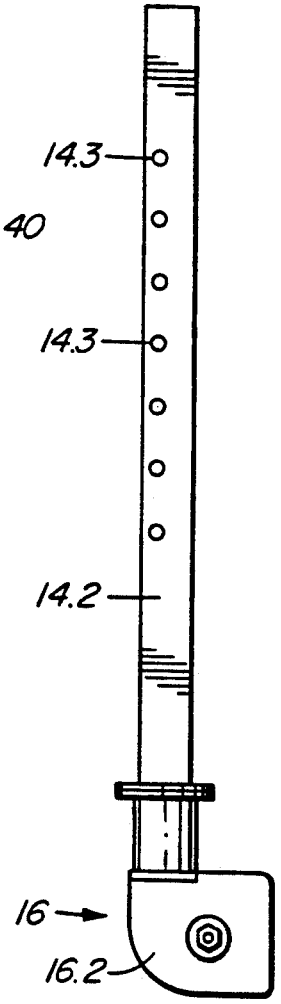
FIGS. 4A and B are two different side views of a lower part of the leg assembly of the system of FIG. 1.
Figure 4B:
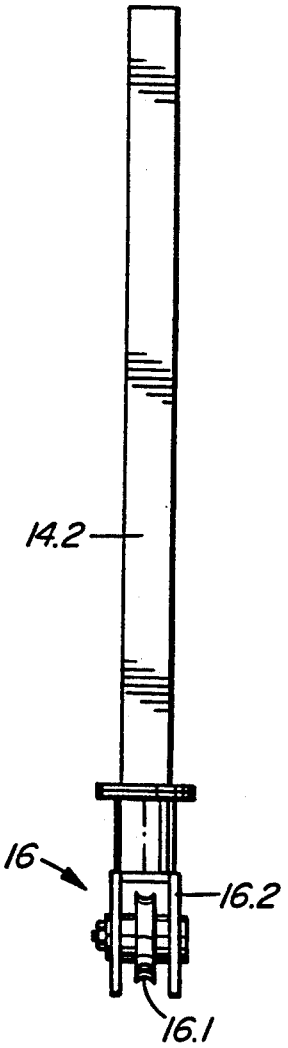
Figure 8A:
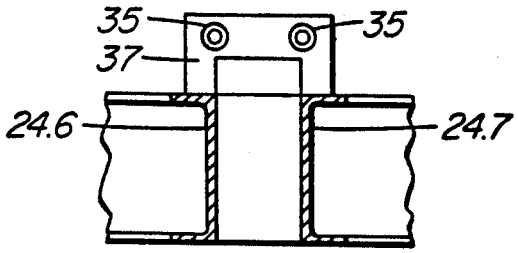
FIGS. 8A and B are side and plan views of cable guide rollers of the system of FIG. 1.
Figure 8B:
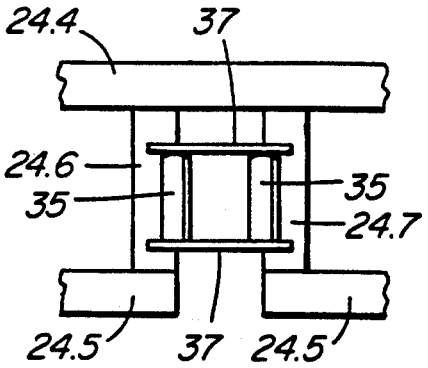

A pair of winch cable guide rollers 35 are provided on a pair of raised support members 37 attached to the members 24.6 and 24.7, as shown in FIGS. 8A and B. The rollers 35 are not shown in FIG. 2C.

Figure 5:
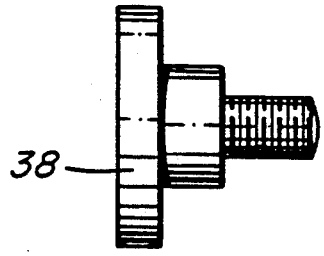
FIG. 5 is a side view of one of a pair of pivot pins for attaching the leg assembly to the winch assembly.

The leg assembly 14 comprises two telescoping square tube members 14.1 and 14.2, the lower member 14.2 being located inside the upper member 14.1. The upper member 14.1 is pivotally connected about a pivotal axis 34 (FIG. 2C) to the members 24.6 and 24.7 of the steel frame 24. The pivotal connection 34 is effected by means of a pair of pivot pins 38 (FIG. 5) extending through openings in the members 24.6 and 24.7, as well as openings in a pair of lugs 40 provided on the upper leg member 14.1.

In order to lock the members 14.1 and 14.2 in different relative positions, a longitudinally spaced series of holes 14.3 is provided in the member 14.2 and a hole 14.4 is provided in the member 14.1 which corresponds with the holes 14.3 in the member 14.2 at a series of different relative positions of the members 14.1 and 14.2. A locking pin (not shown) is also provided. Adjustment of the members 14.1 and 14.2 is effected by removing the locking pin, sliding the members 14.1 and 14.2 relative to each other to set the leg assembly 14 at a desired length and replacing the locking pin to extend through the corresponding holes (14.3, 14.4) in the members 14.1 and 14.2 to lock them together.

The leg assembly 14 is swivelable about the pivotal axis 34 between a horizontal position and a vertical position, as shown in FIG. 1. The horizontal position is for transportation purposes, or transportation can occur with the leg member 14 in the vertical position by simply raising the system 10 by means of the front loader 28 with the frame 24 attached to the arms 28.1. When in operation, the leg assembly 14 is in the vertical position and extends down the service pit 22 as shown in FIG. 1. The leg assembly can be locked in either the vertical or the horizontal position by means of a locking pin (not shown) extending through the members 24.6 and 24.7. A pulling cable 36 extends from the winch 30 and runs inside the square steel sections of the leg assembly 14 from the winch 30 to the reversible pulley assembly 16.

Figure 6A:
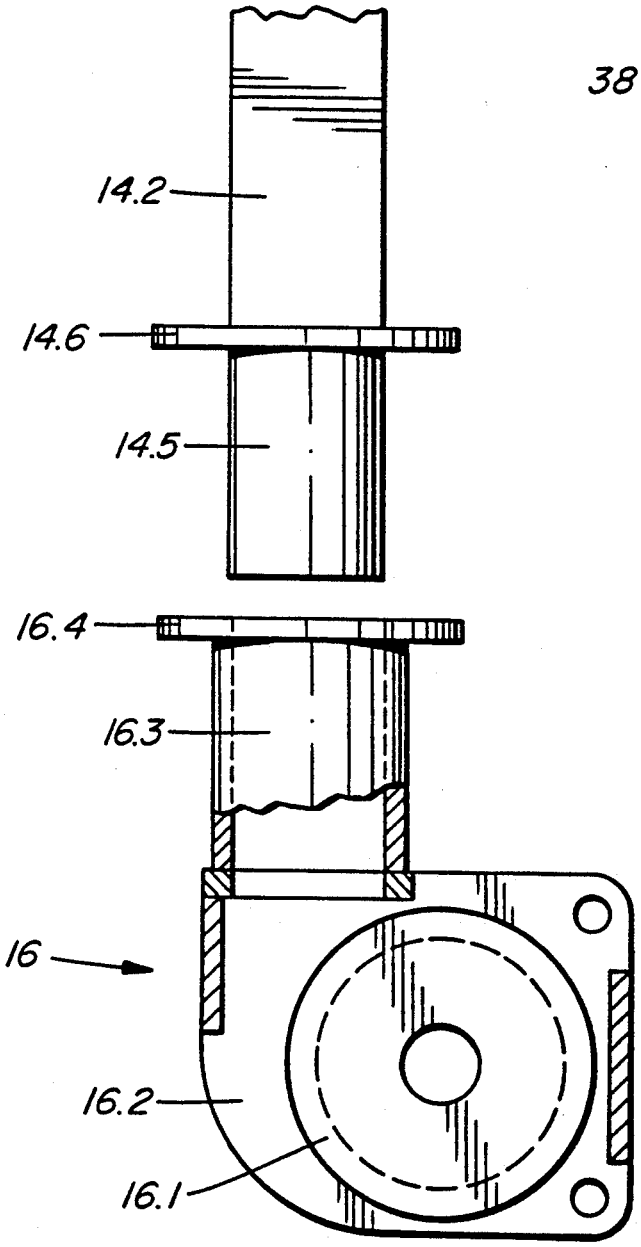
FIGS. 6A–F are various views of a swivelable pulley assembly of the system of FIG. 1.
Figure 6B:
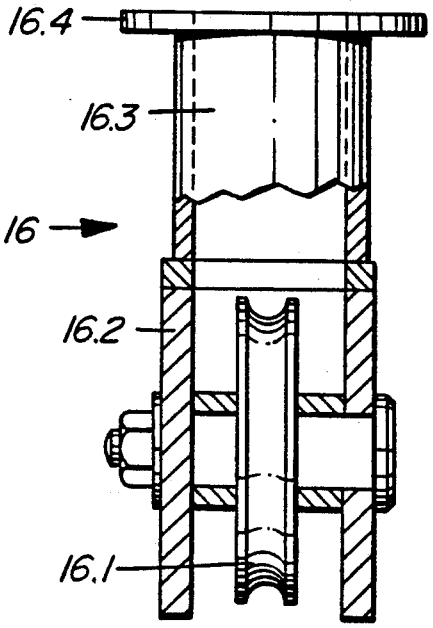
Figure 6C:
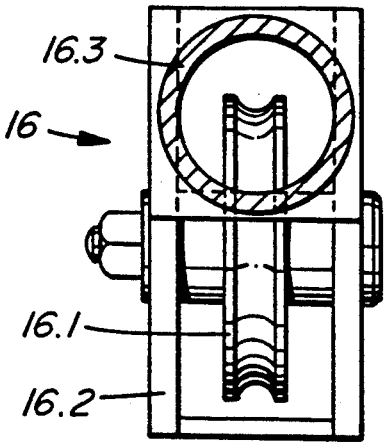
Figure 6D:
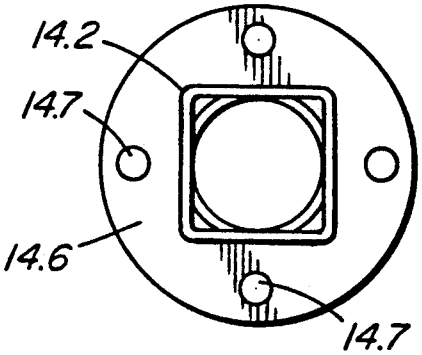
Figure 6E:
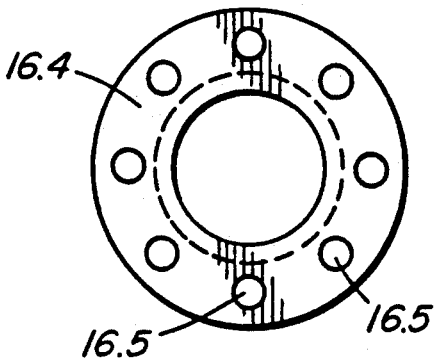
Figure 6F:
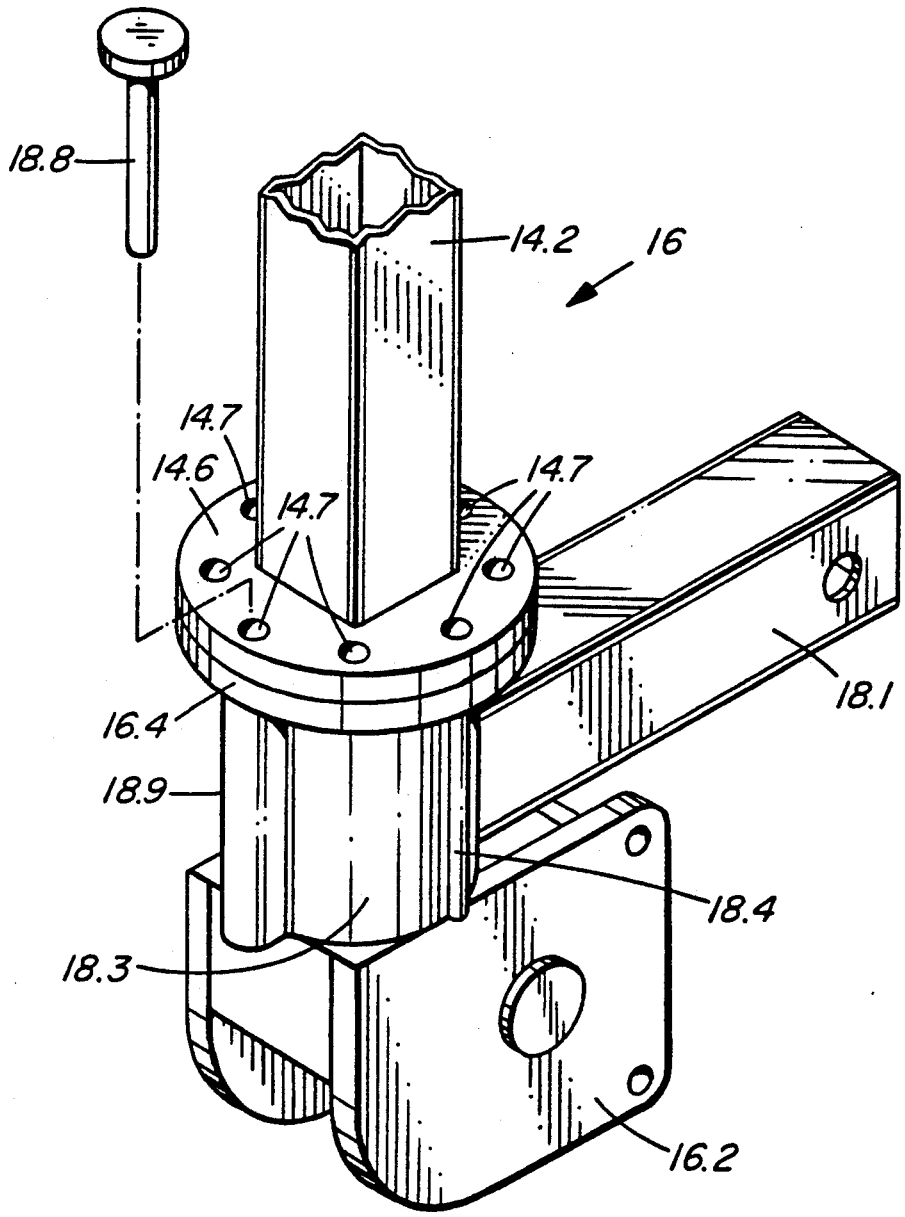

The pulley assembly 16 comprises a pulley 16.1 around which the pulling cable 36 extends. The pulley 16.1 is rotatably supported in a housing 16.2. The housing 16.2 includes a tubular member 16.3 for rotatably receiving the lower tubular end 14.5 of the otherwise square leg member 14.2 therein. Each of the leg member 14.2 and the tubular member 16.3 has a collar 14.6 and 16.4 which are in abutment when the pulley assembly 16 is located in position on the leg member 14.2. As shown in FIGS. 6D and E, the collars 14.6 and 16.4 are provided with circumferentially spaced holes 14.7 and 16.5 therein for attachment together in any one of a variety of relative positions. This is to enable the pulley assembly 16 to be oriented in other desired directions as dictated by various circumstances. In the present example the pulley assembly 16 is adjustable in eight different radial directions. The collars 14.6 and 16.4 are attached together by bolts (not shown).

The extendable support 18 is connected to the lower end of the leg member 14.2 and it comprises a pair of telescopic members 18.1 and 18.2 attached to the leg member 14.2 by means of a round body clamp 18.3, provided with a hinge 18.4. The members 18.1 and 18.2 can be locked into various relative positions. For this 10 purpose, the member 18.2 is provided with a series of spaced holes 18.5 and the member 18.1 with a hole 18.6. This enables the members 18.1 and 18.2 to be locked by means of a locking pin (not shown), for providing a stable support for the leg assembly 14 against the side of the service pit 22 by means of a presser plate 18.7 located at the end of the member 18.2. The support is locked in position relative to the leg 14 by means of a locating pin 18.8 which is received in a locating pin tube 18.9 provided on the round body clamp 18.3. The support 18 can be rotated to support the leg 14 from another position on the inside wall of the service pit, if required, by loosening the clamp 18.3, rotating the support 18 to the desired position and tightening the clamp 18.3. In the present example, the support 18 can be adjusted to four different positions around the leg member 14.

Figure 7A:
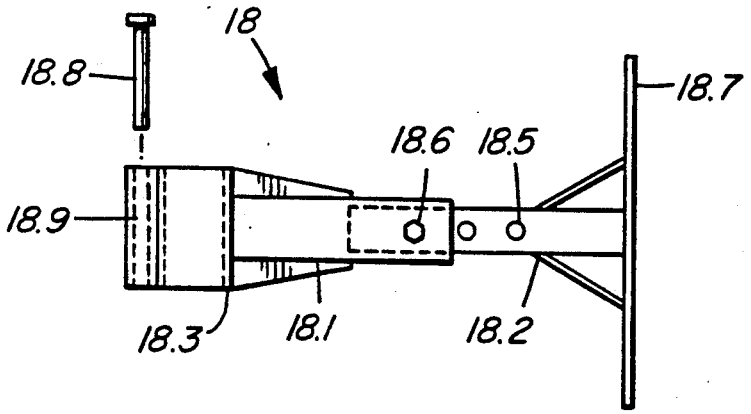
FIGS. 7A and B are two different side views of a leg support member of the system of FIG. 1.
Figure 7B:
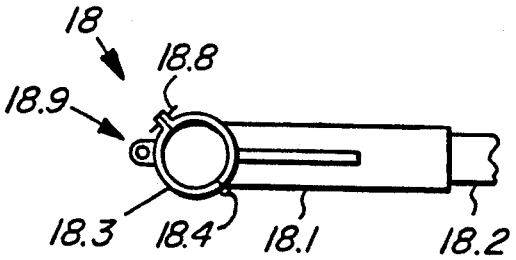
FIG. 7C is a plan view of a presser plate of the leg support member of FIGS. 7A and B.
FIGS. 7D and E are side views showing two different embodiments of the presser plate of FIG. 7C.
Figure 7C:
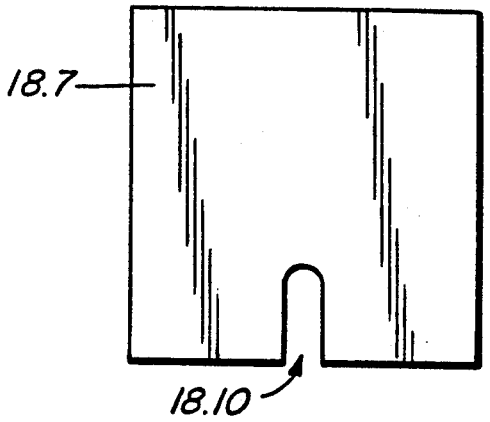
Figure 7D:
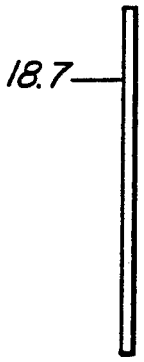
Figure 7E:
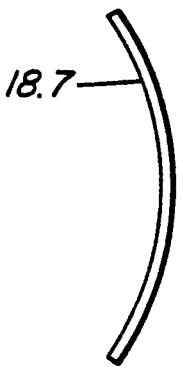

The plate 18.7 is provided with a recess 18.10 for the pulling cable 36 to extend therethrough. As shown in the side views of FIGS. 7D and E, the plate 18.7 can be straight or curved for use in square (rectangular) service pits or round service pits, respectively. For the sake of simplicity, the member 18.2 has been omitted in FIGS. 7D and E.

When replacing a water service lateral, the system 10 is used in the same way as for the replacement of a larger diameter pipe, such as a sewer, as described in co-pending application No. 07/791,513, except that a smaller diameter pulling cable may be used to fit inside the smaller diameter pipe. Most older water service lines are steel or galvanized steel and in such a case a pipe splitter (not shown) is attached to the housing 16.2 at the front of the pulley 16.1 facing the old pipe 20 being replaced, to split the old pipe 20 as it is drawn towards the pulley 16.1. As in the case of a sewer replacement, a new pipe is pulled into place behind the old pipe being removed.

In operation, the arms 28.1 of a front loader or skid steer loader 28 is coupled to the brackets 26 or to the quick attach skid. The laterals replacement assembly 10 is then lowered into the service pit 22 by means of the front loader 28 and adjusted to the required depth by means of the telescopic leg assembly 14. The hydraulic motor 31 of the winch 30 is hooked up to the power unit of the front loader 28.

Figure 10:
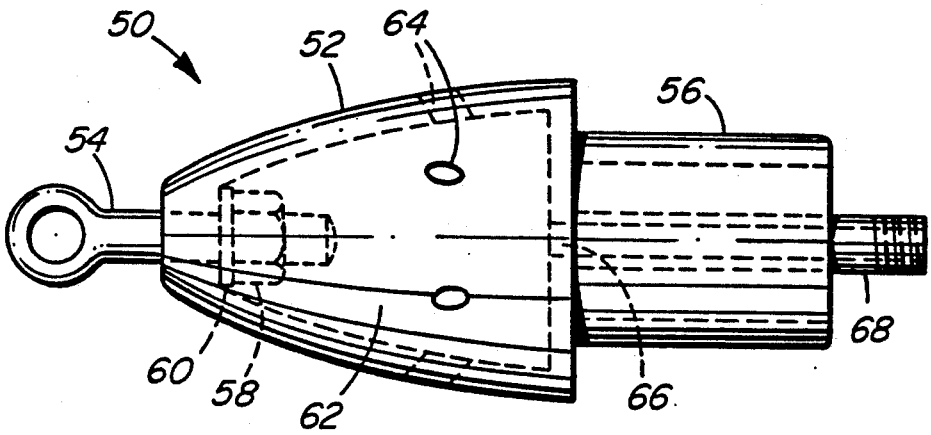
FIG. 10 is a side view of a pipe bursting tool which is suitable for use with the pipe replacement system according to the invention.

The extendable support arm 18 is adjusted to provide firm support for the leg assembly 14 during the pipe replacement operation. The pulling cable 36 is passed through the old pipe 20 to be replaced until it reaches an insertion pit which is spaced some distance away from the service pit 22 at the opposite end of the lateral 20 to be replaced. In the insertion pit, the pulling cable 36 is attached to a pipe bursting tool, such as the one illustrated in FIG. 10 and generally indicated by reference numeral 50.

The pipe bursting tool 50 comprises a hollow conical body 52, provided with an eye bolt 54, for attachment to the pulling cable 36, at its front end and a collar 56 for attachment to a new replacement pipe (not shown) at its rear end for towing the replacement pipe behind the tool 50. The eye bolt 54 is secured in place by means of a brass washer 58 and a locking nut 60. The eye bolt 54 is allowed to swivel during the pipe replacement process.

The tool body 52 defines a chamber 62 on its inside and which is connected to the outside by means of a plurality of circumferentially spaced grouting ports 64. The chamber 62 further has a port 66 at its rear end which is in communication with a connection pipe 68, which may, for example, be a one-inch pipe. A flexible feed pipe, such as a one-inch-high density polyethylene pipe (not shown), is connected to the connection pipe 68 and extends through the new pipe being installed to a Bentonite mixer/pumpmill at the rear of the new pipe for feeding a Bentonite mixture to the chamber 62.

The winch 30 is then operated to retract the cable 36, pulling the bursting tool 50, breaking up the old pipe 20 and installing the new pipe in place. As the tool 50 is being drawn through the old pipe 20, the Bentonite mixture is fed through the grouting ports 64 to lubricate the tool body 52 as well as the new pipe as it is being drawn into position. While specific reference has been made to a Bentonite mixture, it will be appreciated that the description applies equally to any desired type of lubricating or filler mixture which may be required for a particular application.

While only preferred embodiments of the invention have been described herein in detail, the invention is not limited thereby and modifications can be made within the scope of the attached claims.

What is claimed is:

1. Apparatus for the trenchless replacement of a pipe, comprising:

an above-ground frame section for location above a service pit exposing one end of an underground pipe section to be replaced;

an extendable leg member on said above-ground frame section for extending into said service pit;

a support member on said extendable leg member for supporting said leg member against the inside of said service pit;

a cable guide member on said leg member for guiding a pipe pulling cable long said leg member and which guide member is connected to said leg member through connection means which is swiveable about the longitudinal axis of the leg member; and a winch on said above-ground frame section for exerting a pulling force on said pulling cable.

2. The apparatus according to claim 1, wherein the leg member is pivotally connected to said frame section about a horizontal pivotal axis and is capable of movement between a vertical position and a horizontal position about said pivotal axis.

3. The apparatus according to claim 2, further comprising means for locking the leg member in either one of said horizontal or vertical positions.

4. The apparatus according to claim 1, wherein said leg member comprises a plurality of telescoping members.

5. The apparatus according to claim 1, wherein said support member comprises a pair of telescoping members which are connected to said leg member for relative telescoping movement about an axis which is transverse to the longitudinal axis of the leg member.

6. The apparatus according to claim 5, wherein the support member is capable of adjustment into different radial positions about the longitudinal axis of the leg member.

7. The apparatus according to claim 1, wherein said cable guide member comprises a pulley assembly for diverting the pulling cable through a right angle.

8. The apparatus according to claim 1, wherein the above-ground frame portion further comprises an attachment member for attachment of the frame portion to the skid of a mechanical front loader.

9. In combination, a mechanical front end loader and apparatus for the trenchless replacement of a pipe, in which said apparatus comprises:

an above-ground frame section for location above a service pit exposing one end of an underground pipe section to be replaced;

an extendable leg member on said above-ground frame section for extending into said service pit;

a support member on said extendable leg member for supporting said leg member against the inside of said service pit;

a cable guide member on said leg member for guiding a pipe pulling cable along said leg member; and a winch on said above-ground frame section for exerting a pulling force on said pulling cable;

and wherein said front end loader is connected to said above ground frame section, whereby said apparatus can be lowered into a service pit by said front end loader.

10. The apparatus according to claim 9, wherein the leg member is pivotally connected to said frame section about a horizontal pivotal axis and is capable of movement between a vertical position and a horizontal position about said pivotal axis.

11. The apparatus according to claim 10, further comprising means for locking the leg member in either one of said horizontal or vertical positions.

12. The apparatus according to claim 9, wherein said leg member comprises a plurality of telescoping members.

13. The apparatus according to claim 9, wherein said support member comprises a pair of telescoping members which are connected to said leg member for relative telescoping movement about an axis which is transverse to the longitudinal axis of the leg member.

14. The apparatus according to claim 13, wherein the support member is capable of adjustment into different radial positions about the longitudinal axis of the leg member.

15. The apparatus according to claim 9, wherein said cable guide member comprises a pulley assembly for diverting the pulling cable through a right angle.

16. The apparatus according to claim 15, wherein the pulley assembly is capable of swivelling movement about the longitudinal axis of the leg member.

* * * * *